US006457992B2

(12) United States Patent
Posey et al.

(10) Patent No.: US 6,457,992 B2
(45) Date of Patent: Oct. 1, 2002

(54) VISUAL FEEDBACK SYSTEM FOR ELECTRONIC DEVICE

(75) Inventors: Charles E. Posey, Salt Lake City, UT (US); Thomas A. Johnson, Draper, UT (US); David Oliphant, West Jordan, UT (US); Tim U. Price, Bountiful, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/845,078

(22) Filed: Apr. 27, 2001

Related U.S. Application Data

(63) Continuation-in-part of application No. 09/246,534, filed on Feb. 8, 1999, now Pat. No. 6,257,906.

(51) Int. Cl.[7] ..... H01R 3/00
(52) U.S. Cl. ..... 439/490; 439/131
(58) Field of Search ..... 439/488, 489, 439/490, 910, 955

(56) References Cited

U.S. PATENT DOCUMENTS

| | | | | |
|---|---|---|---|---|
| 2,916,720 A | 12/1959 | Steans | ..... | 439/370 |
| 3,500,293 A | 3/1970 | Cocco | ..... | 439/490 |
| 4,136,357 A | 1/1979 | Frederiksen | ..... | 357/72 |
| 4,186,988 A | 2/1980 | Kobler | ..... | 439/676 |
| 4,241,974 A | 12/1980 | Hardesty | ..... | 439/638 |

(List continued on next page.)

FOREIGN PATENT DOCUMENTS

| | | |
|---|---|---|
| EP | 0740370 A1 | 10/1996 |
| EP | 0862245 A1 | 9/1998 |
| EP | 0895318 A2 | 2/1999 |
| GB | 2214007 A | 8/1989 |
| GB | 2229029 A | 9/1990 |

(List continued on next page.)

OTHER PUBLICATIONS

P.E. Knight and D.R. Smith, "Electrical Connector for Flat Flexible Cable," IBM Technical Disclosure Bulletin, vol. 25, No. 1, Jun. 1982.

(List continued on next page.)

*Primary Examiner*—Tulsidas Patel
(74) *Attorney, Agent, or Firm*—Workman, Nydegger & Seeley

(57) ABSTRACT

A visual feedback system for providing information to a user regarding aspects such as the status and operation of the systems and components of one or more electronic devices. The visual feedback system is preferably employed in the context of a PC card and includes one or more light sources, preferably light emitting diodes, configured for electrical communication with the electronic circuitry by which the functionality of the PC card is implemented so that certain events that occur with respect to the status and operation of the PC card cause the light source to emit light. The emitted light is received by a light reflecting member that, preferably, substantially encloses the light source and reflects the received light in a manner and form consistent with a desired application. The reflected light is then directed, by virtue of the geometry of the light reflecting member, to one or more predetermined locations, one of which is preferably proximate to the receptacle of a connector included in the PC card. Thus, light emitted by the light source is correlated with operations performed by, and/or in conjunction with the PC card, and is then directed to a location visible to a user thereby enabling the user to ascertain information regarding aspects such as the status and operation of various electronic systems and components of, or relating to, PC card (100).

27 Claims, 4 Drawing Sheets

U.S. PATENT DOCUMENTS

| | | | | |
|---|---|---|---|---|
| 4,271,455 | A | 6/1981 | McComas | 361/331 |
| 4,303,296 | A | 12/1981 | Spaulding | 439/189 |
| 4,352,492 | A | 10/1982 | Smith | 273/1 |
| 4,379,606 | A | 4/1983 | Clark et al. | 439/76.1 |
| 4,386,818 | A | 6/1983 | Millhimes et al. | 439/490 |
| 4,407,559 | A | 10/1983 | Meyer | 439/536 |
| 4,428,636 | A | 1/1984 | Kam et al. | 439/404 |
| 4,457,570 | A | 7/1984 | Bogese, II | 439/59 |
| 4,564,728 | A | 1/1986 | Romano | 179/175.3 |
| 4,566,749 | A | 1/1986 | Johnston | 439/441 |
| 4,620,070 | A | 10/1986 | Ruehl | 179/175.3 |
| D291,071 | S | 7/1987 | Breil | D10/78 |
| 4,710,136 | A | 12/1987 | Suzuki | 439/374 |
| 4,778,410 | A | 10/1988 | Tanaka | 439/676 |
| 4,789,224 | A | 12/1988 | Bougsty | 350/345 |
| 4,800,466 | A | 1/1989 | Bauer et al. | 362/26 |
| 4,887,876 | A | 12/1989 | Fricke et al. | 350/96.2 |
| 4,915,648 | A | 4/1990 | Takase et al. | 439/490 |
| 4,978,317 | A | 12/1990 | Pocrass | 439/490 |
| 5,035,641 | A | 7/1991 | Van-Santbrink et al. | 439/329 |
| 5,051,099 | A | 9/1991 | Pickles et al. | 439/108 |
| 5,062,807 | A | 11/1991 | Guss, III | 439/440 |
| 5,139,439 | A | 8/1992 | Shie | 439/359 |
| 5,183,404 | A | 2/1993 | Aldous et al. | 439/55 |
| 5,184,282 | A | 2/1993 | Kaneda et al. | 361/395 |
| 5,222,164 | A | 6/1993 | Bass, Sr. et al. | 385/14 |
| 5,268,823 | A | 12/1993 | Yergenson | 362/32 |
| 5,319,527 | A | 6/1994 | Murphy et al. | 362/26 |
| 5,327,328 | A | 7/1994 | Simms et al. | 362/26 |
| 5,336,099 | A | 8/1994 | Aldous et al. | 439/131 |
| 5,338,210 | A | 8/1994 | Beckham et al. | 439/131 |
| 5,345,367 | A | 9/1994 | Pierce et al. | 362/32 |
| 5,359,165 | A | 10/1994 | Leveque et al. | 200/317 |
| 5,391,094 | A | 2/1995 | Kakinoki et al. | 439/638 |
| 5,411,405 | A | 5/1995 | McDaniels et al. | 439/131 |
| 5,457,600 | A | 10/1995 | Campbell et al. | 361/643 |
| 5,463,261 | A | 10/1995 | Skarda et al. | 307/131 |
| 5,474,463 | A | 12/1995 | Robinson et al. | 439/490 |
| 5,481,616 | A | 1/1996 | Freadman | 381/90 |
| 5,487,123 | A | 1/1996 | Fowble | 385/70 |
| 5,499,923 | A | 3/1996 | Archibald et al. | 439/26 |
| 5,505,633 | A | 4/1996 | Broadbent | 439/329 |
| 5,509,811 | A | 4/1996 | Homic | 439/55 |
| 5,513,373 | A | 4/1996 | Damkier | 395/836 |
| 5,538,442 | A | 7/1996 | Okada | 439/676 |
| 5,547,401 | A | 8/1996 | Aldous et al. | 439/676 |
| 5,561,727 | A | 10/1996 | Akita et al. | 385/88 |
| 5,562,504 | A | 10/1996 | Moshayedi | 439/638 |
| 5,597,227 | A | 1/1997 | Bergen et al. | 362/100 |
| 5,608,607 | A | 3/1997 | Dittmer | 361/686 |
| 5,613,873 | A | 3/1997 | Bell, Jr. | 439/490 |
| 5,634,802 | A | 6/1997 | Kerlaan | 439/131 |
| 5,645,577 | A | 7/1997 | Fröberg et al. | 607/37 |
| 5,646,816 | A | 7/1997 | Alden et al. | 361/622 |
| 5,654,873 | A | 8/1997 | Smithson et al. | 361/685 |
| 5,660,568 | A | 8/1997 | Moshayedi | 439/654 |
| 5,667,395 | A | 9/1997 | Okada et al. | 439/131 |
| 5,668,654 | A | 9/1997 | Benjamin et al. | 359/152 |
| 5,679,013 | A | 10/1997 | Matsunaga et al. | 439/144 |
| 5,692,914 | A | 12/1997 | Mitani et al. | 439/131 |
| 5,697,815 | A | 12/1997 | Drewnicki | 439/638 |
| 5,704,802 | A | 1/1998 | Loudermilk | 439/490 |
| 5,727,862 | A | 3/1998 | Wu | 362/27 |
| 5,727,972 | A | 3/1998 | Aldous et al. | 439/655 |
| 5,741,152 | A | 4/1998 | Boutros | 439/490 |
| 5,755,822 | A | 5/1998 | Scheffner | 439/490 |
| 5,759,067 | A | 6/1998 | Sheer | 439/607 |
| 5,767,623 | A | 6/1998 | Friedman et al. | 313/509 |
| 5,773,332 | A | 6/1998 | Glad | 439/344 |
| 5,775,946 | A | 7/1998 | Briones | 439/607 |
| 5,790,041 | A | 8/1998 | Lee | 340/815.45 |
| 5,797,771 | A | 8/1998 | Garside | 439/610 |
| 5,816,832 | A | 10/1998 | Aldous et al. | 439/131 |
| 5,876,239 | A | 3/1999 | Morin et al. | 439/490 |
| 5,885,100 | A | 3/1999 | Talend et al. | 439/490 |
| 5,915,060 | A | 6/1999 | Kerskey et al. | 385/133 |
| 5,915,993 | A | 6/1999 | Belopolsky et al. | 439/490 |
| 5,938,324 | A | 8/1999 | Salmon et al. | 362/555 |
| 5,967,817 | A | 10/1999 | Greenstein | 439/205 |
| 5,971,558 | A | 10/1999 | Peel | 362/26 |
| 6,062,908 | A | 5/2000 | Jones | 439/620 |
| 6,075,215 | A | 6/2000 | Bollinger, Jr. et al. | 200/317 |
| 6,095,851 | A | 8/2000 | Laity et al. | 439/490 |
| 6,113,422 | A | 9/2000 | Somerville et al. | 439/490 |
| 6,116,962 | A | 9/2000 | Laity | 439/676 |
| 6,159,307 | A | * 12/2000 | Madsen et al. | 439/488 |
| 6,217,391 | B1 | 4/2001 | Colantuono et al. | 439/676 |
| 6,224,417 | B1 | 5/2001 | Belopolsky et al. | 439/490 |

FOREIGN PATENT DOCUMENTS

| | | |
|---|---|---|
| GB | 2247118 A | 2/1992 |
| GB | 2247363 A | 2/1992 |
| GB | 2315926 A | 2/1998 |
| GB | 2316816 A | 3/1998 |
| JP | 61-256850 | 11/1986 |
| JP | 11-273795 | * 10/1999 |
| WO | WO 95/13633 | 5/1995 |
| WO | WO 98/46934 | 10/1998 |

OTHER PUBLICATIONS

U.S. patent application Ser. No. 09/528,331, Oliphant et al., filed Mar. 20, 2000.

U.S. patent application Ser. No. 09/528,500, Oliphant et al., filed Mar. 20, 2000.

U.S. patent application Ser. No. 09/528,501, Oliphant et al., filed Mar. 20, 2000.

* cited by examiner

VISUAL FEEDBACK SYSTEM FOR ELECTRONIC DEVICE

CROSS REFERENCE TO RELATED APPLICATIONS

This application is a continuation-in-part (CIP) of U.S. patent application Ser. No. 09/246,534, entitled Functionally Illuminated Electronic Connector With Improved Light Dispersion, filed Feb. 8, 1999, now U.S. Pat. No. 6,257,906, which is incorporated by reference in its entirety.

BACKGROUND OF THE INVENTION

1. Field of the Invention

The present invention generally relates to directing light within an electronic device and, in particular, to a visual feedback system for electronic devices. More particularly, the present invention relates to illuminating all or a portion of a connector to provide visual feedback to a user.

2. Description of Related Art

Various electronic devices, such as computers, personal information managers and personal data assistants, are often configured to include one or more different types of electrical connectors. One conventional type of electrical connector that is frequently used with electronic devices is an RJ-type connector. As known to those skilled in the art, RJ-type connectors are typically used in connection with telephone network and computer communication systems, and these connectors may serve a variety of different purposes. For example, RJ-type connectors, which include a connector plug that is removably received with a receptacle, allow electrical communication to be established between an electrical device and a local or global computer network. This allows data and other information to be transferred between the electronic device and the computer network. Additionally, RJ-type connectors are commonly used to electrically connect telephones and the like to computer networks. Further, RJ-type connectors may be used to transmit electrical power from one device to another.

While conventional RJ-type connectors provide a number of useful features and capabilities, these connectors also suffer from shortcomings that compromise the overall usefulness of the connector. For example, the electrical connection between the RJ-type connector plug and the electronic device is generally hidden from view. Thus, it is often difficult for a user to readily ascertain whether or not the RJ-type connector plug is electrically coupled to the electronic device.

Another problem with conventional RJ-type connectors is determining the status and operation of the electronic device with which the connector interacts. In particular, it is often difficult to determine whether a specific operation or program of the device is active, inactive, complete or ready to be performed. Similarly, parameters such as the operational status of the device are not always readily apparent. For example, it may be difficult to ascertain whether the device is preparing for operation, ready for operation or operational.

It is known to use of various types of diagnostic software in order to obtain feedback regarding the connection of the electronic device to the communication system or network. For example, the user may run diagnostic software to obtain information regarding parameters such as the status and operation of the connector and/or the electronic device with which the connector interacts. While such diagnostic software is somewhat effective, it is problematic in that there are expenses, often significant, associated with obtaining and installing the diagnostic software. Further, there is no guarantee that, even when properly installed, the diagnostic software is functioning properly and providing accurate and complete feedback. Finally, the use of such diagnostic software is often time-consuming and disruptive.

Another known method commonly employed to obtain feedback regarding parameters such as the operation and status of the connector, and/or the devices with which the connector interacts, involves testing various elements of the system hardware or device in which the connector is employed, and/or testing of the connector itself. This approach, however, is problematic for a variety of reasons. For example, many users do not have access to the instrumentation necessary to carrying out such testing. Further, such instrumentation is often expensive, time-consuming to use and difficult to operate.

It is also known to use "light pipes" in conjunction with light emitting diodes ("LED"s) to provide visual feedback to the user of an electronic device. For example, the electronic device may include an LED disposed adjacent to one end of the light pipe. The other end of the light pipe may be disposed in an exterior surface of the electronic device. Light from the LED is transmitted through the light pipe and the user can view the light exiting the end of the light pipe. The light may be used to indicate if the electronic device is active and operational.

Conventional devices utilizing LEDs and light pipes, however, suffer from various shortcomings that impair their effectiveness. One such shortcoming concerns the specific arrangement of the light pipe and the LED. When the LED emits light, a portion of the emitted light enters the light pipe and is conducted to the predetermined location. A large portion of the light emitted by the LED, however, does not enter the light pipe and it typically illuminates the interior portion of the electronic device. Accordingly, conventional devices are inefficient because only a fraction of the light emitted from the LED is actually transported through the light pipe. As a consequence of such inefficiency, the quality of the feedback provided by the light pipe arrangement is compromised.

Another problem inherent in conventional light pipe arrangements is that the light pipe must be precisely placed during assembly so that adequate optical communication between the light pipe and LED is achieved. Ensuring such precise placement adds to the expense of producing devices incorporating a light pipe arrangement.

Yet another shortcoming relating to typical light pipe arrangements concerns the fact that the LED and light pipes are arranged in such a way that dust and other contaminants, such as may be produced during production and/or operation of the electronic device, can accumulate on the LED and/or on the ends of the light pipe. Such contaminants may compromise the efficiency with which light emitted by the LED is passed to the light pipe. Such a reduction in efficiency of light transmission, in turn, compromises the overall operation of the light pipe arrangement and the quality and reliability of the feedback that it provides.

Further, typical light pipes and light pipe arrays are often characterized by complex geometries and frequently necessitate the use of special tooling to facilitate their manufacture. Such special tooling often increases the costs associated with production of the light pipes and light pipe arrays, and thus, the devices in which the light pipes are employed.

Finally, the transmission of the light from the LED to the light pipe is inefficient because the light must pass through different mediums. That is, the light from the LED is first transmitted through the air and then to the end of the light pipe, which is often constructed from a plastic, generally translucent material. As known to those skilled in the art, transmission of the light through different mediums causes undesirable reflections, scattering of the light and other problems resulting in the loss of light.

SUMMARY OF THE INVENTION

A need therefore exists for a visual feedback system that provides information to the user and overcomes the above-described disadvantages and problems.

One aspect of the present invention is visual feedback system that employs one or more light reflecting surfaces to provide effective and reliable feedback to a user regarding aspects such as the operation and status of various electronic systems and devices. Advantageously, the light reflecting surfaces efficiently transfer light while reducing undesirable scattering and loss of light. Significantly, the light reflecting surfaces can direct the light directly from the light source to a target such as a receptacle for receiving a connector plug or an exterior portion of the electronic device.

Another aspect of the visual feedback system is it can be used with a wide variety of electronic devices, such as communication cards that are frequently used with computers or other electronic devices. Preferably the communication card complies with standards established by the Personal Computer Memory Card International Association (PCMCIA) of San Jose, Calif. For example, the communication card can comply with the PCMCIA standards for electronic devices such as a Type I, II or III PC Card, a miniature card, a smart media card, a flash card and the like. It will be appreciated, however, that any suitable type of communication card or electronic device can be used with the visual feedback system.

Yet another aspect is a visual feedback system for a PC card that includes a housing within which is disposed a printed circuit board having electronic circuitry for implementing the functionality of the PC card. The PC card also includes one or more connectors, such as an RJ-type connector or XJACK® type connector manufactured by 3Comm Corp. of Santa Clara, Calif., the assignee of the present application. The connectors preferably allow electrical communication to be established with the electronic circuitry of the printed circuit board. At least one light source, preferably a light emitting diode (LED), is disposed within the housing and arranged for communication with the electronic circuitry of the printed circuit board. The light source is preferably configured so that it emits light, ceases to emit light, and/or intermittently emits light, consistent with various predefined operational and status conditions of the electronic circuitry with which the light source is in communication. One or more light reflecting surfaces or members are disposed proximate to the light source and these surfaces reflect at least a portion of the received light into the connector and/or an outer portion of the PC card.

A further aspect of the visual feedback system is the light reflecting surfaces can extend from the light source to the target, or only a portion of that distance. Additionally, the visual feedback system can include one or more light reflecting surfaces. For example, the visual feedback system can include upper and lower reflecting surfaces that form a channel or path for directing the light. This light path or channel includes an entrance and an exit so that the light is directed to the desired location or target. Preferably, the exit of the light path is located in a portion of a receptacle that is sized to receive a connector plug so that light passing through the exit illuminates at least a portion of the connector plug when it is received within the receptacle. Alternatively, the light may illuminate the receptacle and/or the entire connector plug when it is received within the receptacle.

Another aspect of the visual feedback system is a system that provides various types of information to the user. For example, various operations implemented by the electronic circuitry of the PC card, and/or the device in which it is disposed, can cause the light source to emit light in a characteristic fashion. For example, the light source may provide signals according to a predetermined pattern, different brightness and/or intensity of the light, different colors, etc. Additionally, the system may include a plurality of light sources that may, for example, provide different colors and/or intensities of light.

Still another aspect of the visual feedback system is an efficient system that requires a minimum amount of light and power. For example, because the light reflecting members may enclose all or a portion of the light source, all or a majority of the light may be reflected by the light reflecting members. Additionally, the light reflecting members may be located such that all or a portion of the light is directed to a desired location. Advantageously, the light reflecting members can significantly reduce or eliminate the loss of undesirable light. Significantly, because the visual feedback system efficiently directs the light with a minimum loss of light, that allows a lower-powered or smaller light source to be used.

Yet another aspect of the visual feedback system is light reflecting surfaces that direct the light from the light source to the target without requiring the light to be transmitted through a different medium. This minimizes problems such as undesirable reflections and scattering of the light. Significantly, the target could be an aperture or window in the receptacle that allows light to illuminate all or a portion of the receptacle. This allows a user to ascertain the status of various operational or status parameters of the PC card and/or the device in which the PC card is received by observing the state of illumination of the receptacle. Additionally, light from the light source within the PC card can be transmitted to the receptacle and/or to a translucent plug which is received within the receptacle. In this instance, the user can obtain visual feedback simply by observing the illumination of the plug. Alternatively, the light from the light source could be directed to any desired structure or location, such as an indicator, window or aperture in an outer surface of the device.

These aspects of the invention are effective in providing, among other things, reliable visual feedback to a user in situations when a connector plug is disposed in the receptacle of the connector, and also in situations when no plug is present in the receptacle. Significantly, because the visual feedback system does not require the transmission of light through different mediums, problems such as loss of light, undesirable reflection and scattering of light are significantly reduced.

These and other aspects, features and advantages of the present invention will become more fully apparent from the following description of the preferred embodiments and appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF PREFERRED EMBODIMENTS

Reference will now be made to figures wherein like structures will be provided with like reference designations. It is to be understood that the drawings are diagrammatic and schematic representations of various preferred embodiments of the claimed invention, and are not to be construed as limiting the present claimed invention.

Figure 1:
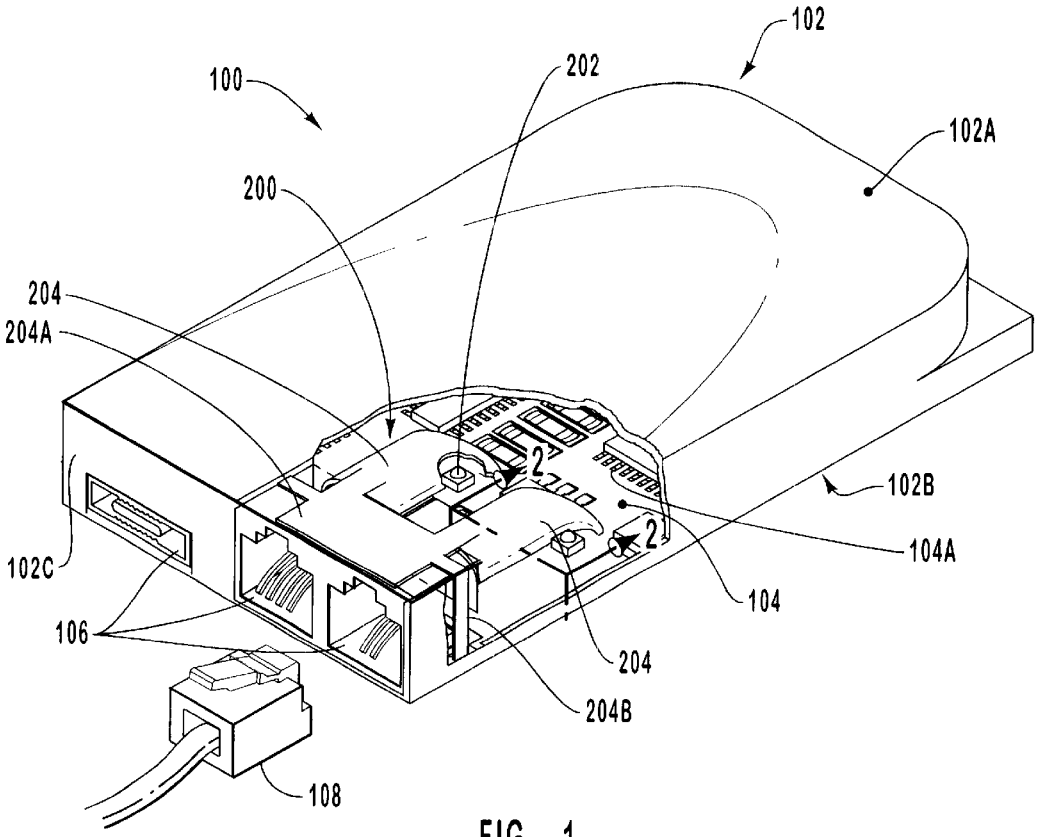
FIG. 1 is an exemplary operating environment for a preferred embodiment of the present invention, illustrating the visual feedback system used in connection with a Type III PC Card.

FIG. 1 illustrates a PC card 100. In general, PC card 100 refers to various peripherals and other devices including, but not limited to, memory cards, modem cards, and the like conforming to standards promulgated by the Personal Computer Memory Card International Association (PCMCIA). It will be appreciated that the PC card 100 provides an exemplary operating environment for preferred embodiments of the present invention, but other embodiments of the present invention are suitable for use in any application where reliable and effective visual feedback is desired. By way of example, embodiments of the present invention are suitable for use in applications including, but not limited to, desktop computers, personal computers, laptop computers, personal data assistants ("PDA"s), and various other types of electrical and electronic devices.

As discussed above, the PC card 100 preferably conforms to the physical design, dimensions, and electrical interface standards consistent with desired industry standards promulgated by the PCMCIA. By way of example, in one embodiment of the invention, the PC card 100 complies with the PCMCIA Type III form factor and is suitable for use in a corresponding PC card slot of a host device (not shown) such as a personal computer, laptop computer, or PDA. It will be appreciated, however, that the form factor of the PC card 100 may be varied to suit particular applications and/or to facilitate achievement of one or more desired results. One skilled in the art will appreciate that the PC card 100 does not have to comply with any particular standards and the visual feedback system could be used with any suitable device.

In general, the PC card 100 includes a housing 102 with a top surface 102A, a bottom surface 102B and a front face 103C that cooperate to define a space within which a printed circuit board (PCB) 104 is generally enclosed. The PCB 104 typically includes various types of electronic circuitry 104A necessary to implement the particular functionality or functionalities associated with the PC card 100. The PC card 100 also includes one or more connectors that allow the PC card 100 to be connected to another device or system, such as a computer network or communications system. In particular, the PC card 100 may include one or more receptacles 106 that are electrically connected to the electronic circuitry 104A and adapted to physically and electrically interface with an appropriate corresponding connector plug 108 so as to facilitate electrical communication between the connector plug and the PC Card. It will be appreciated that the PC card 100 may be in simultaneous electrical communication with one or more devices, and is not limited solely to electrical communication with a host device. Thus, for example, the PC card 100 may be connected to a telephone, network, or remote computer, either by way of a hardwired connection or a wireless connection.

Preferably at least one receptacle 106 is adapted to physically and electrically interface with an RJ-type connector plug, such as an RJ-11 plug or RJ-45 plug. Additionally, one or more of the connectors 106 may be an extendible/retractable connector, such as an XJACK® type connector or the like, adapted to physically and electrically interface with an RJ-type plug. One skilled in the art will appreciate that the PC Card 100 can include other types of suitable connectors such as coaxial cable connectors and the like. Accordingly, any suitable type of connector can be used in connection with the PC card 100.

The PC card 100 additionally includes a visual feedback system, an embodiment of which is indicated generally at 200. In general, the visual feedback system 200 is optically coupled with at least a portion of a connector, such as a receptacle 106, to provide visual feedback to a user. It will be appreciated that such optical coupling may be achieved in various ways consistent with the teachings of the present invention. Exemplary arrangements, discussed in further detail below, include, but are not limited to, the receptacle 106 including an aperture 106B through which light from visual feedback system 200 passes, as well as a connector defining a light path having an entrance proximate to visual feedback system 200.

As shown in the accompanying figures, the visual feedback system 200 includes one or more light sources 202 disposed on the PCB 104 and the light sources are preferably in electrical communication with the electronic circuitry 104A of the PC card 100. The light source 202 preferably comprises a light emitting diode (LED), but it will be appreciated that various other types of light sources may also be used. It will also be appreciated that variables including, but not limited to, brightness, color, duration of illumination, as well as the size, shape, number, types, configuration and arrangement, of the light sources maybe be varied either alone or in various combinations as required to suit a particular application and/or to facilitate achievement of one or more desired results.

The light sources 202 are preferably electrically configured to emit light, cease to emit light, or emit light in a characteristic pattern or fashion, intermittently for example. Preferably, the response of the light sources 202 are indexed to various predetermined events concerning the operation and status of components and systems of PC card 100 and/or components and systems with which PC card interacts, either directly or indirectly, so as to provide visual feedback to a user in order to aid the user in ascertaining such operation and status, among other things.

By way of example, the light source 202 may be electrically configured to emit light when communication has been established between the PC card 100 and a remote device, such as a telephone. Consistent with the foregoing, the light source 202 may further be configured to cease to emit light upon disestablishment of such communication. As another example, the light source 202 may be electrically configured to emit light at such time as one or more electronic circuits of PC card 100 have been energized.

Further, one or more of the light sources 202 may be electrically configured to emit light upon establishment of communication between a host device (not shown) in which PC card 100 is received, and a remote computer network. In this example, the light source 202 may include two different lights, one colored red and one colored green, so that the green light would be illuminated when network communication had been established, and the red light would be illuminated where no network communication had been established. Alternatively, a toggle arrangement could be employed where the green light is illuminated when network communication is established, and the green light is simply extinguished when there is no network communication.

It will be appreciated that the foregoing are simply exemplary arrangements and that the light source 202 may be electrically configured to be responsive to any of a variety of events, or combinations of events, relating to or concerning the operation, status, or the like, of components and systems of PC card 100 and/or components and systems with which PC card interacts.

When the light source 202 emits light, the emitted light is reflected by one or more light reflecting surfaces or members 204 to a desired location or target. As shown in Figure 1, the light reflecting surfaces 204 preferably direct light from the light source 202 to the receptacles 106 that are sized and configured to receive RJ-type connector plugs. In particular, the light reflecting surfaces 204 preferably comprise a single structure that extends from the light source 202 to the receptacle 106, but the light reflecting surfaces could extend between only a portion of the light source and the receptacle. One skilled in the art will appreciate that the light reflecting surfaces could have a variety of suitable configurations and arrangements. Accordingly, the light reflecting surface 204 shown in FIG. 1 is one preferred embodiment, but it will be understood that other arrangements and embodiments of light reflecting surface are intended to be within the scope of the present invention.

The light reflecting surface 204, for example, may also include a plurality of light reflecting surfaces that cooperatively reflect light. In one embodiment, two light reflecting surfaces are disposed opposite each other so as to capture and reflect light between the opposing surfaces. Alternatively, the light reflecting surfaces may enclose all or a portion of the light source, or the light reflecting surfaces may form a generally enclosed conduit or pathway from the light source to the desired target or location. It will be understood that the light reflecting surfaces 204 can have various shapes, sizes, configuration and geometries that are suitable for directing light to the desired location or target. Further, the light reflecting surfaces can be constructed from any desired structure and the surfaces may have any suitable configurations, including, but not limited to, convex, concave, or parabolic.

The light reflecting surfaces 204 may include any type of structure or surface that reflects at least some light, such as mirrors, mirrored surfaces created by suitable paintings or coatings, polished glass surfaces, polished metal surfaces, polished plastic surfaces, stickers and the like. While polished glass, metal and plastic surfaces preferably comprise a slab or block of material with one surface polished or otherwise treated to reflect light, other embodiments of light reflecting surfaces typically include a substrate having disposed thereon or otherwise attached thereto, a reflective coating. It will be appreciated that both the substrate and the reflective coating may each take a variety of forms and that the reflective coating may be disposed on the substrate in any of a variety of different ways. The reflective coating may be applied to the substrate by any suitable process, wherein such processes include, but are not limited to, vacuum metalization, vapor deposition, and metal spattering. Alternatively, the reflective coating may take the form of a reflective surface having an adhesive side that is joined to a suitable substrate.

With respect to the foregoing discussion regarding the various embodiments configurations of light reflecting surfaces 204, it will be appreciated, that various combinations of one or more features of the foregoing examples may be employed in a single application as required to suit a particular application and/or to facilitate a desired result. Details regarding some exemplary preferred embodiments are provided below in the discussion of FIGS. 2 through 10.

As shown in FIG. 1, two light reflecting members 204 are indicated, each corresponding to a respective light source 202.

The light reflecting members 204 are preferably composed of an electrically conductive material, such as metal, and are joined together at one end, as indicated, to cooperatively form an integral ground plane 204A disposed on or above the upper surfaces of the receptacles 106. In this embodiment, ground plane 204A further includes one or more ground path legs 204B, which serve, among other things, to ground connector 106 and/or plug 108 to an appropriate ground connection located on PCB 104. As a result of its grounding functionality, the illustrated embodiment is well suited for use, for example, in conjunction with an Underwriters Laboratory ("UL") Category 5 cable/connector system. It will be appreciated however that such grounding functionality may be profitably employed in conjunction with various other types of cables, plugs, and connectors as well. Alternatively, the light reflecting members 204 do not have to be connected to ground and could, for example, be for added strength.

It will be appreciated that ground plane 204A and ground path legs 204B need not be incorporated in a single, unified structure with light reflecting members 204, and that the functionality provided by ground plane 204A and ground path legs 204B may be supplied by way of a structure separate and distinct from light reflecting members 204. Furthermore, as discussed herein, light reflecting members 204 need not be composed of an electrically conductive material, but may comprise any of a variety of other materials as well.

Figure 2:
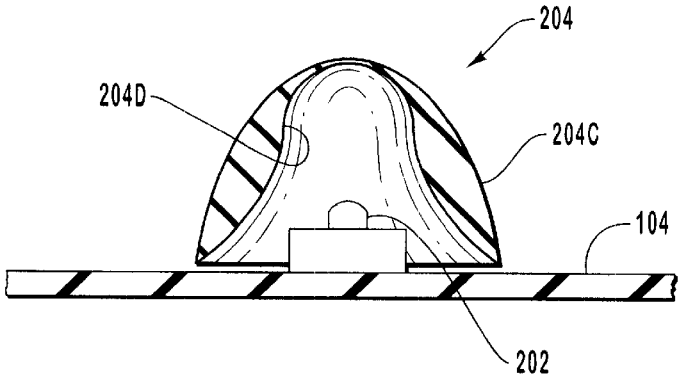
FIG. 2 is a cross sectional side view along lines 2—2 of the visual feedback system shown in FIG. 1, illustrating the light source attached to the printed circuit board.
Figure 3:
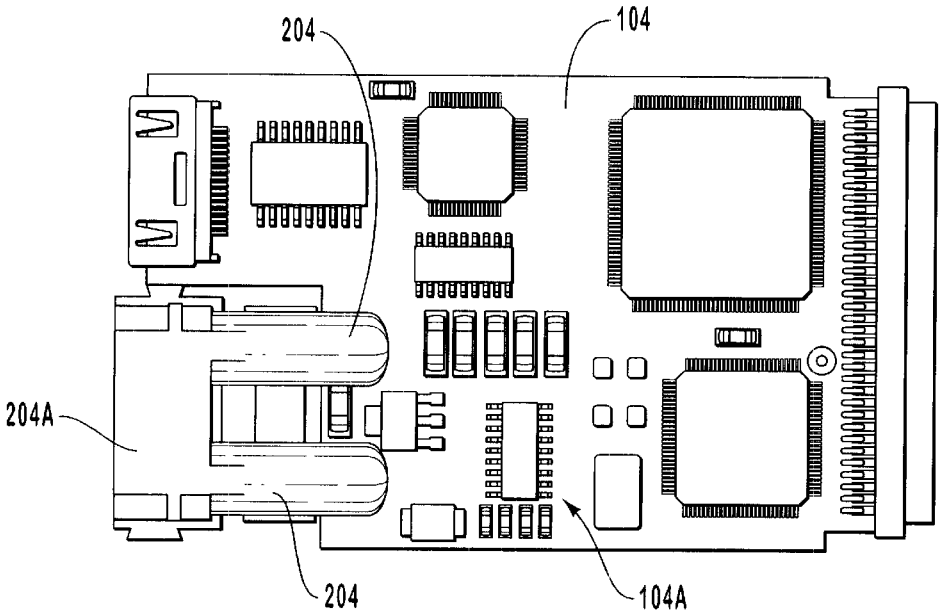
FIG. 3 is a top view of the visual feedback system shown in FIG. 1 with the top cover removed, illustrating the printed circuit board and light reflecting surfaces.
Figure 4:
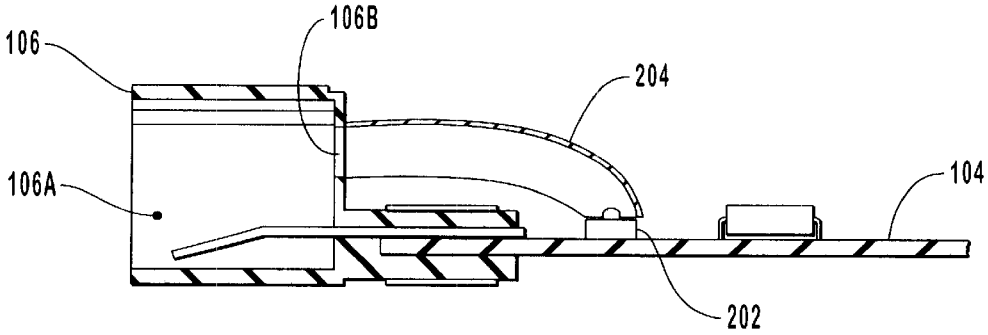
FIG. 4 is a cross sectional side view of a portion of the visual feedback system shown in FIG. 3, illustrating light reflecting surfaces in accordance with a preferred embodiment of the present invention.

Directing attention now to FIGS. 2 through 4, and with continuing attention to FIG. 1, additional details are provided regarding a preferred embodiment of visual feedback system 200. In particular, one embodiment of light reflecting surface 204 comprises a single piece of material formed into a substantially tunnel-shaped body 204C that includes a reflective surface 204D, which encloses all or a portion of the light source 202. As a result of this configuration, a substantial portion of the light emitted by light source 202 is captured by light reflecting member 204.

Note that while the embodiment of visual feedback system 200 illustrated in FIGS. 1 through 4, discloses a light reflecting member 204 of single piece construction, it will be appreciated that visual feedback system 200 may include two or more light reflecting members. One embodiment of such an arrangement is considered in further detail below in the context of the discussion of FIG. 5.

After receiving the light emitted by the light source 202, the reflective surface 204C reflects the received light along a predetermined path to one or more desired targets or locations. As indicated in FIG. 1, the light reflecting members 204 reflect the light so that the light is visible in a location that is proximate to the front face 102C of the PC card 100. More specifically, the light reflected by light reflecting member 204 is preferably directed to a location proximate to the receptacle 106. Advantageously, the light may be used to illuminate the receptacle 106. Additionally, the light may be used to illuminate the connector plug 108 when it is received within the receptacle. In particular, as best seen in FIG. 4, the connector plug 108 is preferably at least partially translucent or includes a translucent portion that is optically coupled to the visual feedback system 200 by the aperture or opening 106B in the receptacle 106. The aperture 106B allows light to enter the receptacle 106 and the connector plug 108 when it is received within the receptacle. The aperture 106B could also comprise a window or other structure that allows at least some of the light to pass into the receptacle. Accordingly, visual feedback may be provided to the user when the connector plug 108 is inserted into the receptacle 106, as well as situations where the connector plug is not inserted into the receptacle.

Figure 5:
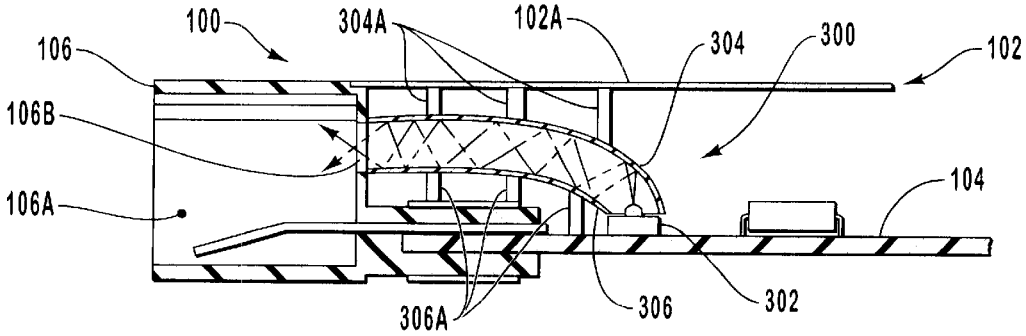
FIG. 5 is a cross sectional side view of a portion of the visual feedback system shown in FIG. 3, illustrating light reflecting surfaces in accordance with another preferred embodiment of the present invention.

As shown in FIG. 5, various details are provided regarding an alternative embodiment of a visual feedback system, indicated generally at 300. In the illustrated embodiment, the visual feedback system 300 includes one or more light sources 302, preferably comprising an LED, or the like, disposed on PCB 104 and electrically configured to be in electrical communication with electronic circuitry 104A (not shown). Preferably, the visual feedback system 300 is arranged in the context of a PC card 100 having at least one connector 106 in electrical communication with electronic circuitry 104A.

The visual feedback system 300 includes an upper light reflecting member 304 and a lower light reflecting member 306, which cooperate to substantially enclose light source 302 such that light emitted by light source 302 is captured and reflected between the upper light reflecting member and the lower light reflecting member 306. The upper and lower light reflecting members 304 and 306 cooperatively direct the light through the aperture 106B and into the interior portion 106A of the connector 106. As indicated in the illustrated embodiment, the upper light reflecting member 304 and the lower light reflecting member 306 are supported and retained in place by respective support structures 304A and 306A. Support structures 304A and 306A serve to, among other things, ensure that the upper light reflecting member 304 and the lower light reflecting member 306 are positioned for light capturing and reflection performance consistent with the contemplated application.

It will be appreciated that the visual feedback system 300 may be assembled in any of a variety of ways. For example, in the context of the embodiment illustrated in FIG. 5, the upper light reflecting member 304 is preferably joined to the top cover 102A of the PC card 100 and the lower light reflecting member 306 is attached to the receptacle 106, PCB 104 or bottom cover 102B. Advantageously, when the top cover 102A is attached to the bottom cover 102B during assembly of the PC card 100, the upper light reflecting member 304 and the lower light reflecting member 306 assume the proper relative position with respect to each other. Of course, various other assembly techniques and processes may likewise be used with equal effect in this regard, and are accordingly contemplated within being in the scope of the present invention. Additionally, it will be appreciated that a plurality of light reflecting members may be used and arranged so that they collectively provide the functionality of upper light reflecting member 304 and lower light reflecting member 306 of FIG. 5.

Figure 6:
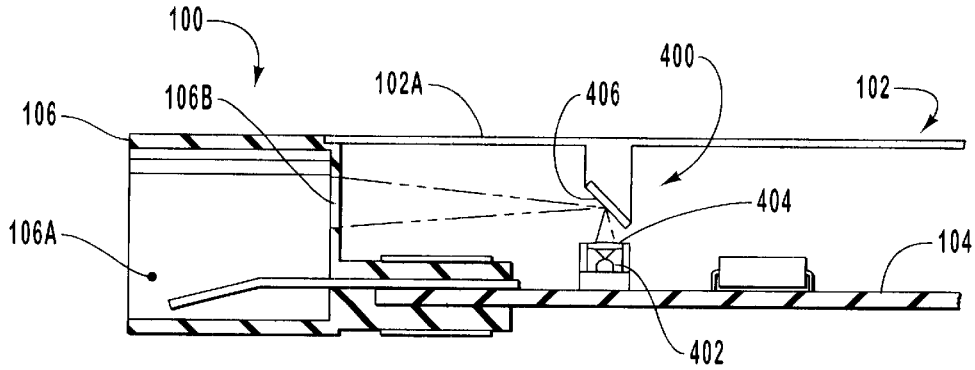
FIG. 6 is a cross sectional side view of yet another preferred embodiment of the visual feedback system.

As shown in FIG. 6, another preferred embodiment of a visual feedback system 400 includes a PC card 100 with one or more receptacles 106 arranged for electrical communication with electronic circuitry 104A (not shown) disposed on the PCB 104. The receptacle 106 includes an interior portion 106A and an aperture 106B which facilitates, among other things, optical coupling of light emitted by visual feedback system 400 to receptacle 106. The visual feedback system 400 directs light through the aperture 106B to provide feedback to a user regarding various operations and conditions with respect to the functionality of PC card 100, and or devices with which the PC card 100 interfaces. Generally, the visual feedback system 400 includes one or more light sources 402, preferably comprising LEDs configured for electrical communication with electronic circuitry 104A. The visual feedback system 400 also includes at least one lens 404 and at least one light reflecting member 406, such as a substantially planar mirror, that are positioned to direct the light through aperture 106B to illuminate the receptacle 106 and/or the connector plug 108 (not shown) received therein. Preferably, light reflecting member 406 is supported and positioned by structural elements of top cover 102A of PC card 100.

It will be appreciated that variables including, but not limited to, the size, number, shape, type, spacing, arrangements, and optical characteristics, of lens 404 and/or light reflecting member 406 may be varied either alone, or in various combinations, as required to facilitate achievement of one or more desired results and/or to suit a particular application. By way of example, lens 404 may alternatively be placed in the path of light reflected from light reflecting member 406 to achieve a desired effect or result with respect to the feedback provided by visual feedback system 400. Further, one or more lenses 404 may be selected so as to cause a desired effect, scattering or focusing for example, with respect to light emitted by light source 402.

Figure 7:
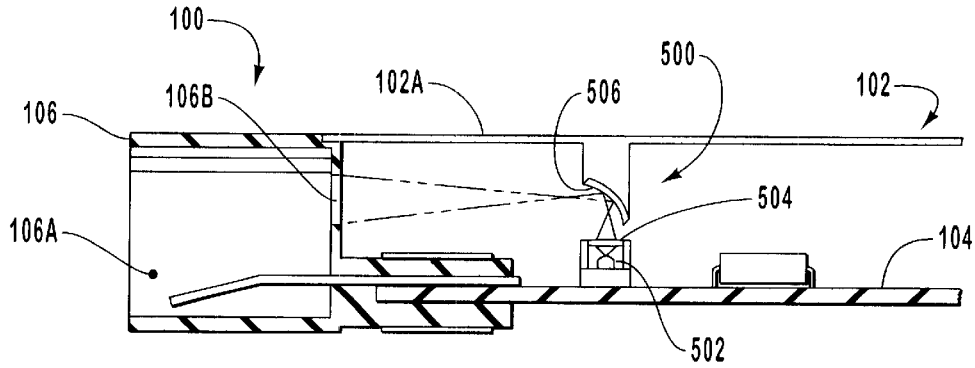
FIG. 7 is a cross sectional side view of still another preferred embodiment of the visual feedback system.

Directing attention now to FIG. 7, visual feedback system 500 includes at least one light source 502, preferably comprising an LED or the like, in electrical communication with electronic circuitry (not shown) disposed on the PCB 104. In the illustrated embodiment, the PCB 104 is disposed within the PC card 100 that includes a top cover 102A, which includes structure that positions and supports a light reflecting member 506. The visual feedback system 500 also includes a lens 504 that is positioned to receive at least some of the light emitted by light source 502. It will be understood that the lens 504 may be selected in accordance with particular desired optical properties, such as a lens that is optically configured to focus and/or collimate light emitted by the light source 502. Preferably, light reflecting member 506 comprises a parabolic mirror, so as to concentrate and reflect the light received from light source 502 by way of lens 504.

The visual feedback system 500 operate in a similar manner to the visual feedback system 400. In particular, light emitted by light source 502 is passed through lens 504 so as to achieve one or more desired results or effects with respect to the emitted light. Then, the light passing through lens 504 is reflected by the light reflecting member 506 through the aperture 106B of the receptacle 106 of the PC card 100, thereby providing visual feedback to the user as to various operations and/or status of the PC card. As in the case of other embodiments of the present invention, the embodiment illustrated in FIG. 7 is preferably used in conjunction with a substantially translucent plug 108 (not shown), so that the visual feedback provided by visual feedback system 500 can be transmitted through aperture 106B and ultimately into plug 108 so as to provide visual feedback to a user even when plug 108 is disposed in PC card 100.

Figure 8:
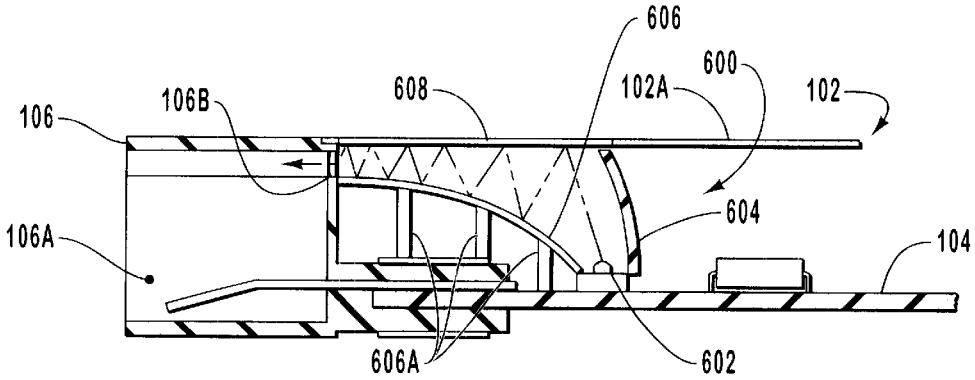
FIG. 8 is a cross sectional side view of yet another preferred embodiment of the visual feedback system.

Turning now to FIG. 8, yet another alternative embodiment includes a visual feedback system 600 wherein at least a portion of the light is reflected by the top cover 102A of the PC card 100. The visual feedback system 600 includes one or more light sources 602, at least one of which preferably comprises an LED in electrical communication with electronic circuitry of PCB 104. Preferably, light emitted by the light source 602 is cooperatively captured and reflected by a first light reflecting member 604 and a second light reflecting member 606. Preferably, the first light reflecting member 604 and the second light reflecting member 606 are integral with each other and are held in position by way of suitable support structure 606A. While in the illustrated embodiment, the first light reflecting member 604 and the second light reflecting member 606 each substantially comprises a curved surface, it will be appreciated that the light reflecting members may have any suitable configurations.

In addition to the first light reflecting member 604 and the second light reflecting member 606, the visual feedback system 600 further includes an upper light reflecting surface 608, preferably incorporated as a portion of top cover 102A of PC card 100. It will be appreciated that the upper light reflecting member 608 may take a variety of forms. By way of example, the upper light reflecting member 608 may simply comprise a polished portion of the underside of top cover 102A. As another example, the upper light reflecting member 608 may comprise a light reflective coating sprayed onto a selected portion of the underside of top cover 102A. As yet another example, the upper reflecting member 608 may comprise a discrete panel, installed in a corresponding opening of the top cover 102A, which includes a reflective underside positioned to reflect light rays emitted by the light source 602 and/or reflected by the first or second light reflecting members 604 or 606. As a further example, the upper light reflecting member 608 may comprise a reflective foil or the like having adhesive on one surface and attach to the underside of top cover 102A and positioned so as to reflect light emitted by the light source 602 and/or reflected by the first or second light reflecting members 604 or 606.

In operation, at least a portion of the light emitted by light source 602 is received by the first light reflecting member 604, the second light reflecting member 606 and/or upper light reflecting member 608. This light is directed through aperture 106B. As discussed above, light from the visual feedback system 600 is directed through aperture 106B and illuminates at least a portion of the receptacle 106 and/or the connector plug 108 received within the receptacle.

Figure 9:
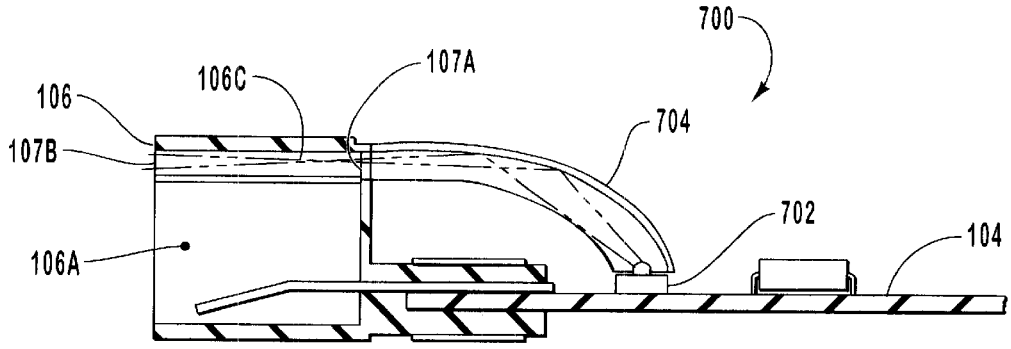
FIG. 9 is a cross sectional side view of another preferred embodiment of the visual feedback system.

As shown in FIG. 9, a visual feedback system 700 includes at least one light source and a light reflecting member 704 configured and arranged to reflect light emitted by light source in a predetermined direction or to a predetermined location. The visual feedback system 700 includes a light source 702 that is preferably disposed within a PC card 100. The PC card 100 includes a receptacle 106, preferably an RJ-type receptacle, and a light path 106C that is optically coupled with visual feedback system 700 so that the light reflected and directed by light reflecting member 704 passes along light path 106C. In an alternative to the embodiment of the invention illustrated in FIG. 9, light source 702 is mounted to, or proximate, the rear of connector 106 so that light emitted by light source 702 passes directly into light path 106C without the intermediate reflection provided by light reflecting member 704 of the illustrated embodiment.

It will be appreciated that while light path 106C is preferably configured so that light exiting light path 106C does so in a location proximate to the front of receptacle 106, the light path 106C may be configured in a variety of different ways to direct light received from light reflecting member 704 to various other predetermined locations. It will further be appreciated that receptacle 106 may include a plurality of light paths 106C, consistent with a desired result or functionality.

Preferably, the light path 106C comprises a hollow passage lined with suitable reflective material and the light path includes an entrance 107A and an exit 107B. The exit 107B is preferably located proximate the front of the receptacle 106, but it will be appreciated that light path 106C may be constructed in a variety of other ways consistent with the teachings of the present invention. By way of example, light path 106C may be formed by molding a plurality of light reflecting surfaces within the body of receptacle 106 so that such light reflecting surfaces cooperate to direct light from light reflecting member 704 in a form and manner consistent with the contemplated application.

It will be appreciated that the foregoing are simply exemplary implementations of the functionality provided by light path 106C, and that light path 106C may be constructed in any of a variety of different ways consistent with the embodiments of the present invention. Accordingly, the foregoing exemplary embodiments of light path 706 should not be construed as limiting the scope of the present invention in any way.

As discussed above in the context of FIGS. 6 and 7, various embodiments of the visual feedback system may include one or more lenses as required to achieve a desired effect and/or to facilitate achievement of one or more desired results. It will be appreciated that the selection and/or placement of such a lens, or lenses, as well as the optical properties of such lenses, may be varied as necessary to suit a particular application.

Figure 10:
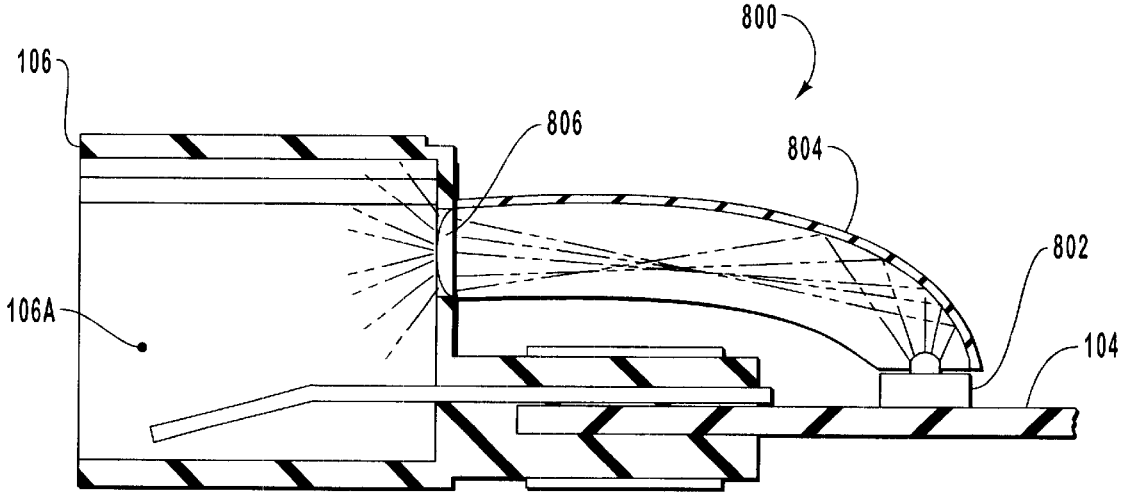
FIG. 10 is a cross sectional side view of a further preferred embodiment of the visual feedback system.

In the embodiment illustrated in FIG. 10, a visual feedback system 800 includes one or more light sources 802, preferably comprising LEDs, that are electrically configured to communicate with electronic circuitry 104A (not shown)

disposed on the PCB 104. A light reflecting member 804 disposed proximate to light source 802 serves to receive light emitted by light source 802 and to reflect the received light in a form and manner consistent with the contemplated application. In the illustrated embodiment, visual feedback system 800 additionally includes one or more lenses 806 arranged to receive light reflected by light reflecting member 804 and to create one or more desired effects with respect to such received light.

For example, the lens 806 is configured to receive light emitted by light reflecting member 804 and scatter the received light within receptacle 106 of connector 106. It will be appreciated, however, that various different types of lenses 806, or a combination thereof, may be employed as desired to suit a particular application and/or to achieve one or more desired effects with respect to the properties of the visual feedback provided by visual feedback system 800.

In view of the foregoing discussion of various embodiments of the invention, it will be appreciated that aspects of such embodiments may be combined and employed in a variety of ways consistent with the teachings of the present invention. Thus, the illustrated embodiments are exemplary combinations only, and the scope of the present invention should not be construed solely to the embodiments illustrated herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An electronic device, comprising:

(a) a housing;

(b) a printed circuit board including electronic circuitry and being substantially disposed within said housing;

(c) at least one connector in communication with said electronic circuitry and defining a receptacle configured to physically and electrically interface with an electrical plug; and (d) a visual feedback system optically coupled with a portion of said at least one connector, and including:

(i) at least one light source in communication with said electronic circuitry, emission of light from said at least one light source being indexed to occurrence of at least one predetermined event relating to said electronic circuitry; and (ii) at least one light reflecting member configured and arranged to receive light emitted by said at least one light source and to reflect at least some received light into said portion of said connector with which said visual feedback system is optically coupled;

wherein said electronic device further comprises a ground plane disposed on top of said at least one connector and attached to said at least one light reflecting member.

2. The electronic device as recited in claim 1, further comprising a plug ground connection path integral with said ground plane.

3. An electronic device, comprising:

(a) a housing;

(b) a printed circuit board including electronic circuitry and being substantially disposed within said housing;

(c) at least one connector in communication with said electronic circuitry and defining a receptacle configured to physically and electrically interface with an electrical plug;

(d) a visual feedback system optically coupled with a portion of said at least one connector, and including:

(i) at least one light source in communication with said electronic circuitry, emission of light from said at least one light source being indexed to occurrence of at least one predetermined event relating to said electronic circuitry; and (ii) at least one light reflecting member configured and arranged to receive light emitted by said at least one light source and to reflect at least some received light into said portion of said connector with which said visual feedback system is optically coupled; and (e) at least one lens interposed between said at least one light source and said at least one light reflecting member.

4. In an electronic device having a housing and a printed circuit board, the printed circuit board including electronic circuitry and being disposed within the housing, a visual feedback system for conveying information concerning the electronic device, the visual feedback system comprising:

(a) at least one light source in communication with the electronic circuitry, emission of light from said at least one light source being indexed to occurrence of at least one predetermined event relating to the electronic circuitry;

(b) means for reflecting light, said means for reflecting light receiving light emitted by said at least one light source and reflecting some received light at least indirectly out of the housing; and (c) at least one lens, said at least one lens being arranged to pass light from said at least one light source to said means for reflecting light.

5. In an electronic device having a housing and a printed circuit board, the printed circuit board including electronic circuitry and being disposed within the housing, a visual feedback system for conveying information concerning the electronic device, the visual feedback system comprising:

(a) at least one light source in communication with the electronic circuitry, emission of light from said at least one light source being indexed to occurrence of at least one predetermined event relating to the electronic circuitry;

(b) at least one light reflecting member configured and arranged to receive light emitted by said at least one light source and to reflect at least some received light at least indirectly out of the housing; and (c) at least one lens interposed between said at least one light source and said at least one light reflecting member.

6. In an electronic device including a light source in communication with electronic circuitry and including at least one light reflecting member positioned to receive light from the light source, and at least one lens, a method for providing visual feedback concerning the electronic device, the method comprising:

(a) generating, with the light source, light within the electronic device;

(b) receiving some generated light at a light reflecting member; and (c) reflecting, with the light reflecting member, at least some received light to a first predetermined location;

wherein at least some light from the light source is passed through the at least one lens prior to reflection of said received light by said at least one light reflecting member.

7. A PC card, comprising:

(a) a housing;

(b) a printed circuit board including electronic circuitry and being substantially disposed within said housing;

(c) at least one RJ-type connector in communication with said electronic circuitry and defining a receptacle defining an aperture and configured to physically and electrically interface with an RJ-type plug;

(d) a visual feedback system, including:

(i) at least one light emitting diode in communication with said electronic circuitry, emission of light from said at least one light emitting diode being indexed to occurrence of at least one predetermined event relating to said electronic circuitry; and (ii) at least one light reflecting member, said at least one light reflecting member receiving light emitted by said at least one light emitting diode and reflecting some received light through said aperture and into said receptacle defined by said connector; and (e) at least one lens interposed between said at least one light emitting diode and said at least one light reflecting member.

8. An electronic device, comprising:

a housing;

a printed circuit board disposed within the housing and including electronic circuitry and electronic components;

a connector in electrical communication with the electronic circuitry, the connector including a receptacle that is sized and configured to receive a media plug, the connector being configured to allow electrical communication to be established between the media plug and the electronic circuitry when the plug is received within the receptacle; and a visual feedback system for directing light to a target without transmitting the light through a different medium, the visual feedback system including:

a light source in communication with said electronic circuitry; and a light reflecting surface that is sized and configured to reflect light from the light source to the target, the light reflecting surface being a parabolic mirror.

9. The electronic device as recited in claim 8, wherein the light reflecting surface is configured to form a light reflective pathway.

10. The electronic device as recited in claim 8, wherein the light reflecting surface is at least partially curved in order to direct light towards the target.

11. The electronic device as recited in claim 8, wherein the target is at least a portion of the connector.

12. The electronic device as recited in claim 8, wherein the target is at least a portion of an outer surface of the housing.

13. The electronic device as recited in claim 8, wherein the target is at least a portion of the media plug when the media plug is received within the receptacle in the connector.

14. The electronic device as recited in claim 8, wherein the light reflective surface extends generally from the light source to the target.

15. The electronic device as recited in claim 8, wherein the light reflecting surface forms a portion of said housing.

16. In an electronic device including a housing, a printed circuit board with electronic circuitry and electronic components disposed within the housing, a connector in electrical communication with the electronic circuitry and including a receptacle that is sized and configured to receive a media plug, and a visual feedback system disposed within the housing for transmitting light to a target, the visual feedback system capable of conveying information concerning the electronic device to a user, the visual feedback system comprising:

a light source in communication with the electronic circuitry, the light source emitting light according to one or more predetermined events; and a light reflecting surface that is sized and configured to reflect at least some of the light emitting from the light source to a target without the emitted light being transmitted through a change in medium, the light reflecting surface being a parabolic mirror.

17. The visual feedback system as recited in claim 16, wherein the target is at least a portion of the connector.

18. The visual feedback system as recited in claim 16, wherein the target is at least a portion of an outer surface of the housing.

19. The visual feedback system as recited in claim 16, wherein the target is at least a portion of the media plug when the media plug is received within the receptacle in the connector.

20. A communication card that is capable of being connected to an electronic device such as a computer, the communication card comprising:

a housing;

a circuit board disposed within the housing, the circuit board including electronic circuitry and electronic components;

a connector in electrical communication with the electronic circuitry of the circuit board, the connector being sized and configured to removably receive a RJ-type connector plug; and a visual feedback system, including:

a light source in communication with the electronic circuitry of the circuit board; and a light reflecting member that is sized and configured to receive light emitted from the light source and reflect the light to a target without transmitting the light through a different medium, the light reflecting surface being a parabolic mirror.

21. The communication card as recited in claim 20, wherein the light reflecting member is configured to form a light reflective pathway.

22. The communication card as recited in claim 20, wherein the light reflecting member is at least partially curved in order to direct light towards the target.

23. The communication card as recited in claim 20, wherein the target is at least a portion of the connector.

24. The communication card as recited in claim 20, wherein the target is at least a portion of an outer surface of the housing.

25. The communication card as recited in claim 20, wherein the target is at least a portion of the media plug when the media plug is received within the receptacle in the connector.

26. The communication card as recited in claim 20, wherein the light reflective member extends generally from the light source to the target.

27. The communication card as recited in claim 20, wherein the light reflecting member forms a portion of said housing.

* * * * *